US008471158B2

(12) United States Patent
Salagean

(10) Patent No.: US 8,471,158 B2
(45) Date of Patent: Jun. 25, 2013

(54) POWER SEAT SWITCH ASSEMBLY

(75) Inventor: Alexandru Salagean, Mississauga (CA)

(73) Assignee: Omron Dualtec Automotive Electronics Inc., Oakville (CA)

( * ) Notice: Subject to any disclaimer, the term of this patent is extended or adjusted under 35 U.S.C. 154(b) by 265 days.

(21) Appl. No.: 12/969,185

(22) Filed: Dec. 15, 2010

(65) Prior Publication Data

US 2011/0147187 A1 Jun. 23, 2011

Related U.S. Application Data

(60) Provisional application No. 61/287,419, filed on Dec. 17, 2009.

(51) Int. Cl.
*H01H 9/26* (2006.01)

(52) U.S. Cl.
USPC ..... 200/5 A

(58) Field of Classification Search
USPC ..... 200/4, 5 A, 6 A, 339, 5 R, 5 B, 5 E, 200/6 R, 17 R, 18, 329, 50.32, 50.33, 50.35
See application file for complete search history.

(56) References Cited

U.S. PATENT DOCUMENTS

| | | | | |
|---|---|---|---|---|
| 4,204,098 | A | 5/1980 | Strande | |
| 4,918,264 | A | 4/1990 | Yamamoto et al. | |
| 5,147,990 | A | 9/1992 | Dionisio, Jr. et al. | |
| 5,350,893 | A | 9/1994 | Yamauchi et al. | |
| 5,396,030 | A | 3/1995 | Matsumiya et al. | |
| 5,725,087 | A | 3/1998 | Ives | |
| 5,866,862 | A * | 2/1999 | Riffil et al. | 200/5 R |
| RE36,738 | E | 6/2000 | Matsymiya et al. | |
| 6,274,826 | B1 * | 8/2001 | Serizawa et al. | 200/5 R |
| 6,525,278 | B2 * | 2/2003 | Villain et al. | 200/5 R |
| 6,765,165 | B1 * | 7/2004 | Torrens | 200/512 |
| 7,170,018 | B2 | 1/2007 | Ilkhanov | |
| 7,368,673 | B2 | 5/2008 | Sato | |
| 7,382,695 | B2 | 6/2008 | Matsui | |
| 2010/0187083 | A1 | 7/2010 | Morrison et al. | |

FOREIGN PATENT DOCUMENTS

WO WO 2010/135810 A1 12/2010

OTHER PUBLICATIONS

Hijazi, Mazen; International Search Report from corresponding PCT Application No. PCT/CA2010/002001; search completed Mar. 18, 2011.

* cited by examiner

*Primary Examiner* — Edwin A. Leon
(74) *Attorney, Agent, or Firm* — Brett J. Slaney; John R. S. Orange; Blake, Cassels & Graydon LLP

(57) ABSTRACT

A switch assembly is provided that includes a series of bridge actuators that include oppositely spaced protrusions separated by a bridge. The protrusions extend through apertures in a support that provides a sliding surface for overlying actuator plates. The actuator plates include ramps to act on the protrusions and in turn activate underlying dome switches. The bridge actuators utilize an angled underside to provide better alignment with the top surface of the dome to reduce shearing. The switch assembly also includes a sub-assembly that uses a micro switch cell in a knob instead of a PCB to reduce the number of connections. The sub-assembly uses an elastomeric keypad to preload a button on the knob and provide tactile feel. The switch assembly also includes a four-way knob that provides distinct feel to the directions of movement using a contoured male-female connection that uses tabs and slots, a contoured female connection and a protrusion on the tip of the male connector.

12 Claims, 16 Drawing Sheets

$$Fko = kx\,tg\alpha \frac{1}{1 - \mu \sin\alpha \cos\alpha} \left[ \frac{\beta(1 - 2\mu \sin\alpha \cos\alpha)}{1 - \mu \sin\alpha(\cos\alpha - \beta \sin\alpha)} + \mu \cos^2\alpha \right]$$

$$\beta = \frac{tg\alpha + \mu}{1 - \mu\, tg\alpha}$$

POWER SEAT SWITCH ASSEMBLY

CROSS-REFERENCE TO RELATED APPLICATIONS

This application claims priority from U.S. Provisional Application No. 61/287,419 filed on Dec. 17, 2009, the entire contents of which are incorporated herein by reference.

TECHNICAL FIELD

The following relates generally to electrical switches and has particular utility in automotive switches.

BACKGROUND

Electrical switches are often used in automotive applications to control features in an automobile, e.g. power windows, seat adjustments, door locks, etc. Often, in order to provide a tactile feel to a switch, elastomeric collapsible domes are often used, which are activated through movements of an actuation knob or a knob in combination with a plunger or linkage. Elastomeric domes can be prone to premature failure or a reduced lifespan if shear forces caused by non-perpendicular forces acting on the dome are not avoided or at least minimized. It is therefore important to consider the action forces in an electrical switch when using such domes.

In automotive applications, many switches are multi-functional and the differentiation between the functions is often also important. In addition to these considerations, the space available for the components of the switches may be limited and thus a lower profile is usually desirable as well as having fewer components.

It is therefore an object of the following to address the above-noted considerations.

SUMMARY

In one aspect, there is provided a switch assembly comprising: a housing; an elastomeric pad supported by the housing to overly a circuit board comprising a plurality of lower contacts, the elastomeric pad comprising a plurality of collapsible domes aligned with corresponding ones of the lower contacts, the domes each comprising an upper contact that engages a respective lower contact when collapsed; one or more bridge actuators, each bridge actuator being supported by the housing between the elastomeric pad and a support surface, each actuator having a first end and a second end, each end being aligned with one of the plurality of domes and having an upwardly directed protrusion extending through a corresponding aperture in the support surface; one or more actuator plates supported atop the support surface, each actuator plate having a ramp formed in its underside and aligned adjacent each upwardly directed protrusion such that a sliding movement of the actuator plate over the support surface engages the ramp with the protrusion to cause the protrusion to move in a downward direction towards a respective underlying dome to actuate a corresponding switch.

In another aspect, there is provided a bridge actuator for actuating a pair of underlying elastomeric domes, the bridge actuator configured to be supported by a housing between the elastomeric domes and a support surface, the actuator having a first end and a second end, each end being aligned with a respective one of the pair of underlying elastomeric domes and having an upwardly directed protrusion sized to extend through a corresponding aperture in the support surface.

In yet another aspect, there is provided an actuator knob for operating one or more switches on a switch assembly, the actuator knob comprising: a housing comprising an interface for connecting the knob to the switch assembly and an open-ended cavity; a sub-assembly integrated into the cavity, the sub-assembly comprising a secondary knob pivotable with respect to the housing, the secondary knob comprising an actuation portion for engaging a micro switch in the cavity upon movement of the secondary knob, the sub-assembly also comprising an elastomeric pad interposed between the secondary knob and the housing to provide tactile feel and elastic pre-load.

In yet another aspect, there is provided an actuator assembly for actuating a plurality of switches, the assembly comprising: a base; an upstanding post extending from the base, the post comprising a spherical distal end and a slotted portion corresponding to a direction of movement of the knob which corresponds to one of the plurality of switches; a rocker knob supported by the post by a set of prongs sized to receive the spherical distal end of the post and permit multi-directional movement of the knob with respect to the base, the prongs also sized to extend into corresponding slotted portions to limit rotation of the knob about an axis defined by the post, the knob also comprising an actuation foot for each switch positioned about the knob such that each foot is aligned with a switch member supported by the base such that movement of the knob in a direction corresponding to one of the feet actuates a corresponding switch.

BRIEF DESCRIPTION OF THE DRAWINGS

Embodiments will now be described by way of example only with reference to the appended drawings wherein.

DETAILED DESCRIPTION OF THE DRAWINGS

Figure 1:
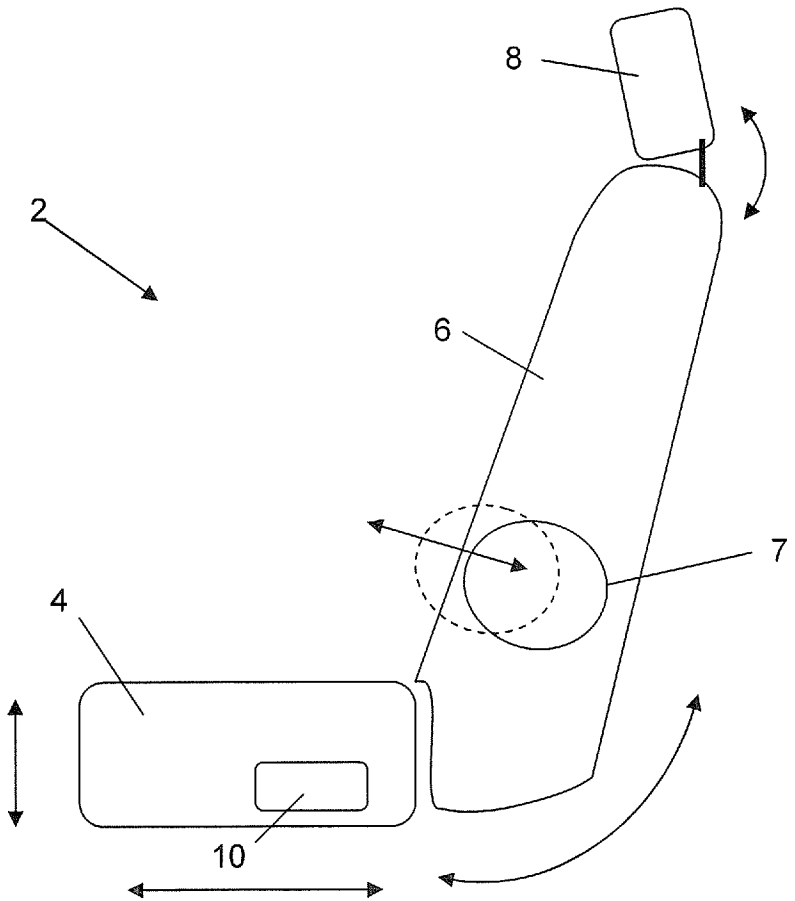
FIG. 1 is schematic diagram of a powered automotive chair.

Turning now to the figures, FIG. 1 illustrates a schematic diagram of a powered automotive chair 2. The chair 2 comprises a seat 4, a backrest 6, and a headrest 8, each of which is controlled by one or more switch knobs on a power seat switch assembly 10. As can be seen in FIG. 1, the switch assembly 10 enables, among other things, up/down and forward/backward movements of the seat 4, rotation of the backrest 6, lumbar adjustment of the backrest 6, and tilting movements of the headrest 8 as indicated by the arrows.

Figure 2:
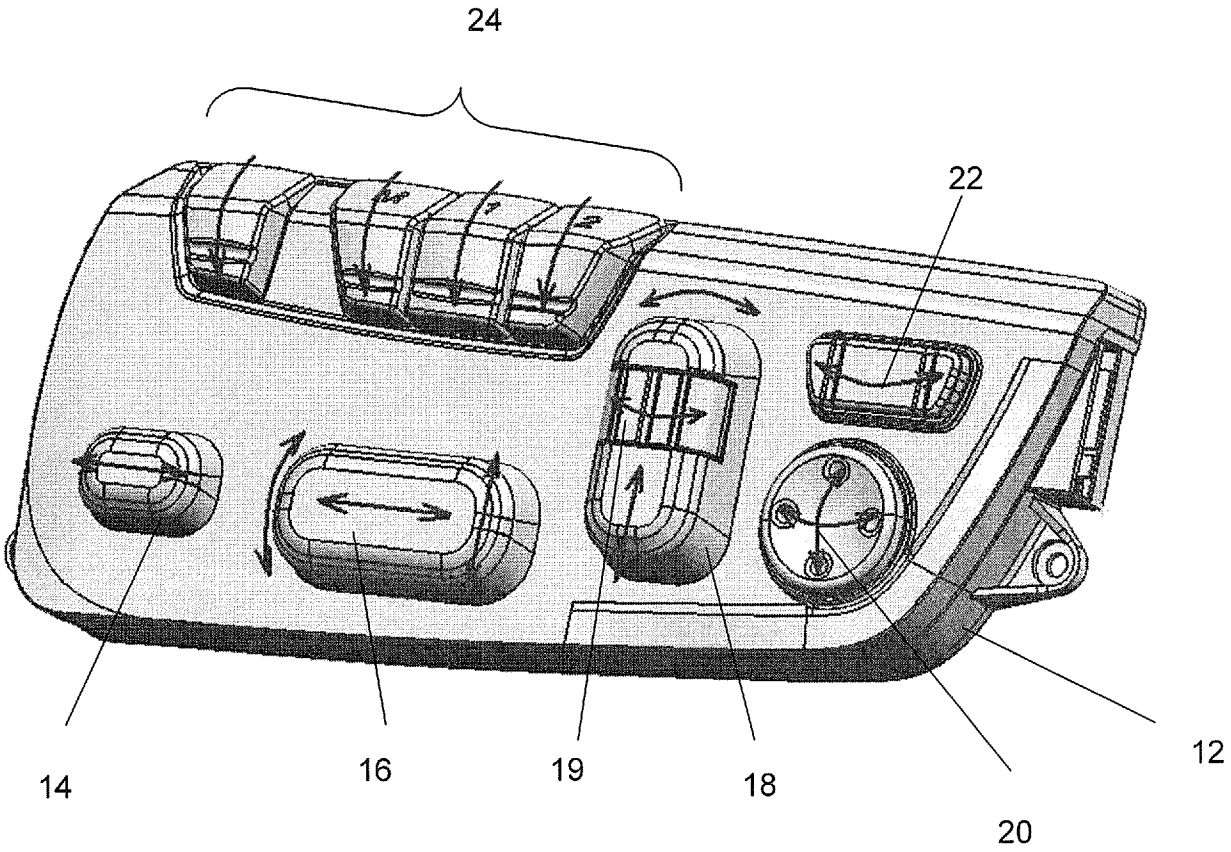
FIG. 2 is a perspective view of a power seat switch assembly in isolation.

The exterior of one example of the switch assembly 10 is shown in FIG. 2. The switch assembly 10 comprises a shroud or outer housing 12 that encloses various components of the switch assembly 10 and is sized and configured to be attachable to the exterior of the seat 4. The housing 12 supports or otherwise defines the location of a number of functional buttons or "knobs" that control the configurations for the chair 2, such as those shown in FIG. 1. A seat depth knob 14 is used to control the length of the seat 4. A seat function knob 16 is used to control the seat angle (tilting the leftmost end), the seat's horizontal position (slide forward or backward), and the seat's vertical position (tilting the rightmost end). A recline knob 18 which, as explained below is part of a switch sub-assembly, is used to adjust the height of the headrest 8 (slide vertically), adjust the recline angle of the backrest 6 (tilting uppermost end). A bend backrest button 19 is integrated into the recline knob 18 and is used to operate a folding action for the backrest 6. A lumbar knob 20 is used to provide 4-way adjustment of a lumbar component 7 of the backrest 6 and a rocker button 22 is used to enable adjustment of the width of the backrest 6. A series of angled rocker buttons 24 are also shown, which can be used for other features such as massage and memory functions.

Figure 3:
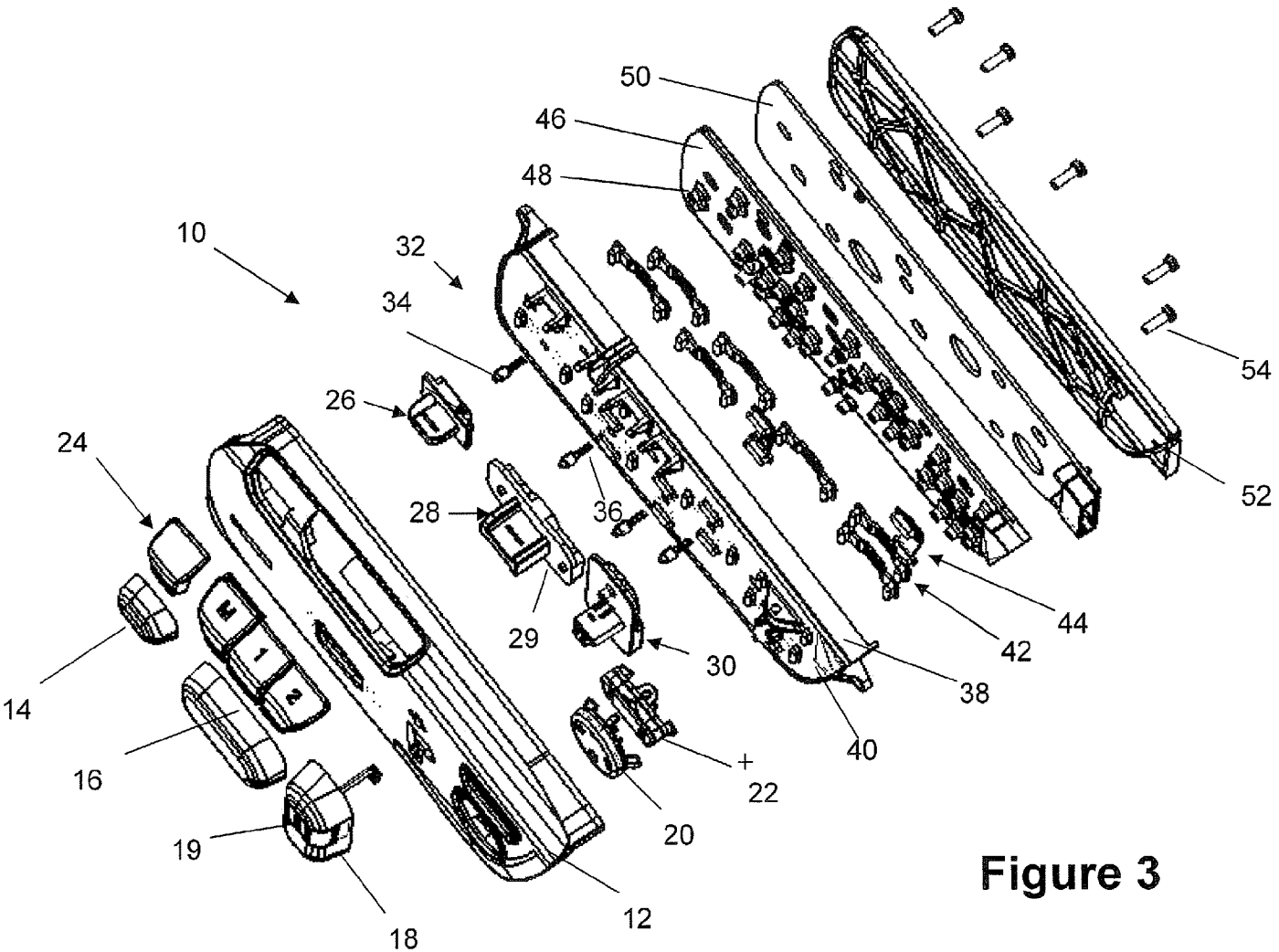
FIG. 3 is an exploded perspective view of the seat switch assembly shown in FIG. 2.

An exploded view of the switch assembly 10 is shown in FIG. 3 illustrating detail of various components enclosed by the housing 12. A backing plate 52 provides support for various layers within the assembly 10 and can be secured to the housing 12 using a series of fasteners 54 (e.g. screws). The backing plate 52 supports a printed circuit board (PCB) 50, which in turn supports an overlying elastomeric layer 46 (e-pad 46 hereinafter). The e-pad 46 itself comprises a series of elastomeric domes 48 that are configured to be aligned with underlying circuit contacts on the PCB 50, for making electrical connections and actuating switches to operate corresponding functions, in this example for adjusting the chair 2. An inner support 38 covers the e-pad 46 and provides separation between a set of overlying actuator plates 26, 28, 30 that slide over an upper surface thereof, and the e-pad 46. Although not shown in FIG. 3, as will be explained in greater detail below, the support 38 comprises a series of posts 56 that extend downwardly from the underside of the support 38 and terminate against the e-pad 46. The posts 56 guide in the assembly of various bridge actuators 42, 44 and comprise hollow, open ended cores to contain plunger assemblies 32 as explained below.

Figure 10:
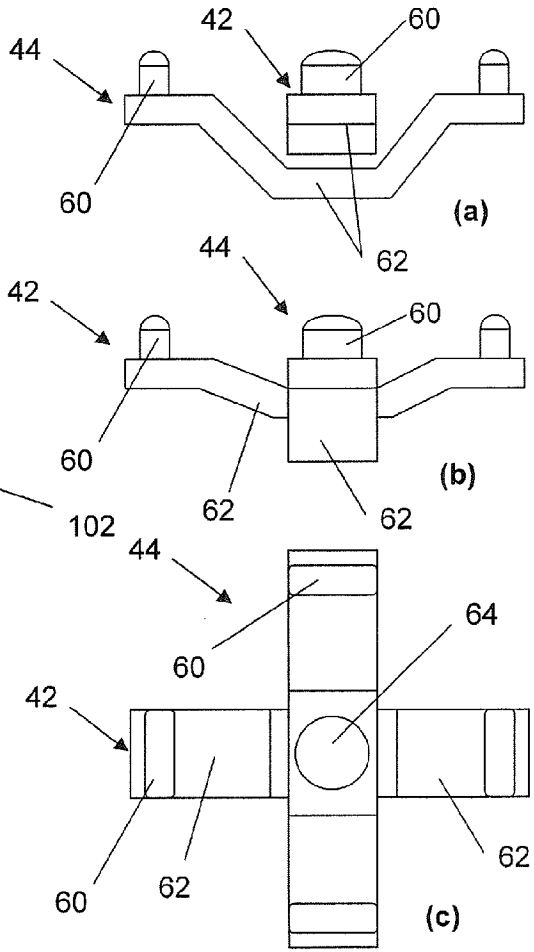
FIG. 10 is a series of view of a pair of bridged actuators.

In FIG. 3, bridge actuators that have a relatively lower profile are denoted by numeral 42 and may hereinafter be referred to as primary actuators 42. Bridge actuators that have a relatively higher profile and in this figure are aligned generally perpendicular to the primary actuators 42 (to enable a primary actuator 42 to be stacked thereon as shown in FIG. 10), are denoted by numeral 44 and may hereinafter be referred to as secondary actuators 44.

The support 38 comprises a series of apertures 40, each being aligned with a protrusion 60 at each end of the actuators 42, 44. As noted above, the support 38 comprises an upper surface that provides a sliding surface for actuator plates 26, 28, and 30. A first actuator plate 26 is generally aligned with and is operated by the seat depth knob 14, a second actuator plate 28 is generally aligned with and is operated by the seat function knob 16, and a third actuator plate 30 is generally aligned with and is operated by the recline knob 18. It can be appreciate therefore that the housing 12 comprises apertures that enable the actuator plates 26, 28, and 30 to protrude beyond the housing 12 to be secured to the corresponding knobs 14, 16, and 18 respectively. Plunger assemblies 32 are used to preload and provide a return force for the actuator plates 26, 28, and 30. Each plunger assembly 32 comprises a plunger element 34 and a spring 36 to bias the plunger element 34 against the actuator plate 26, 28, 30. The posts 56 accommodate the springs 36 and enable the plunger elements 34 to slide therein.

Figure 4:
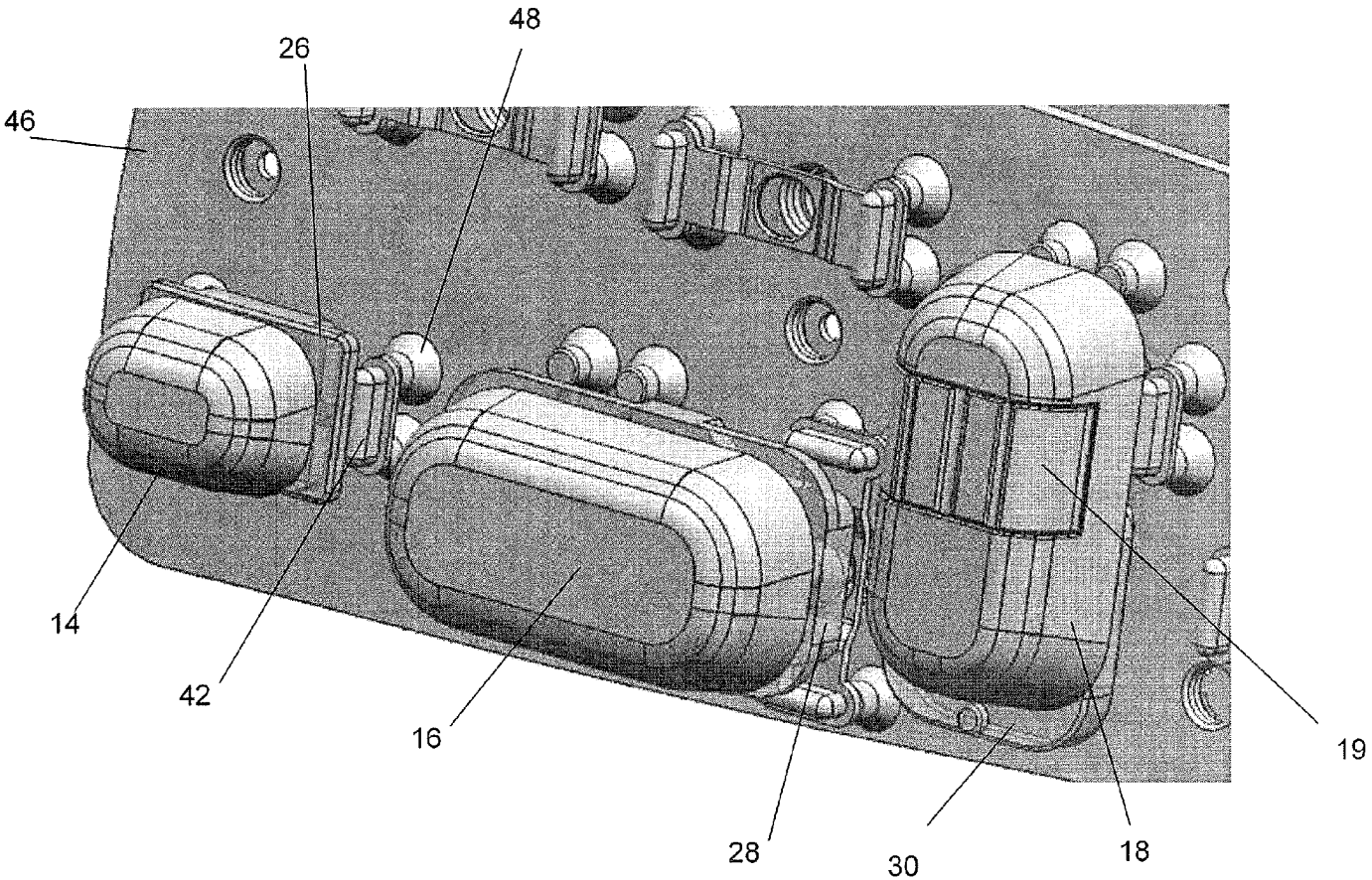
FIG. 4 is a perspective view of three individual switch assemblies from the assembly of FIG. 2 with the housing removed.
Figure 5:
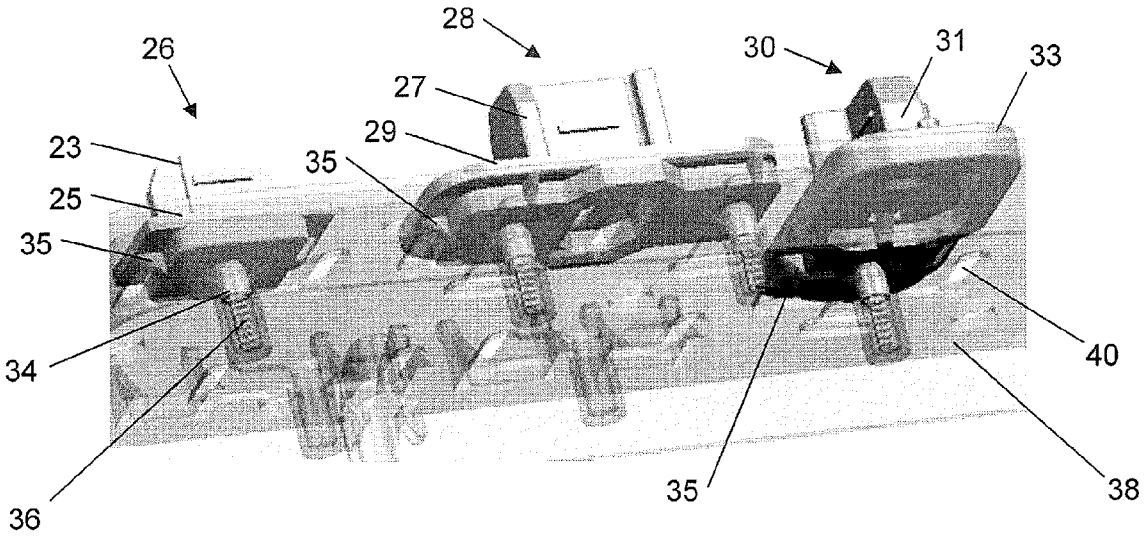
FIG. 5 is a perspective view from the underside of slider elements shown in FIG. 4.
Figure 6:
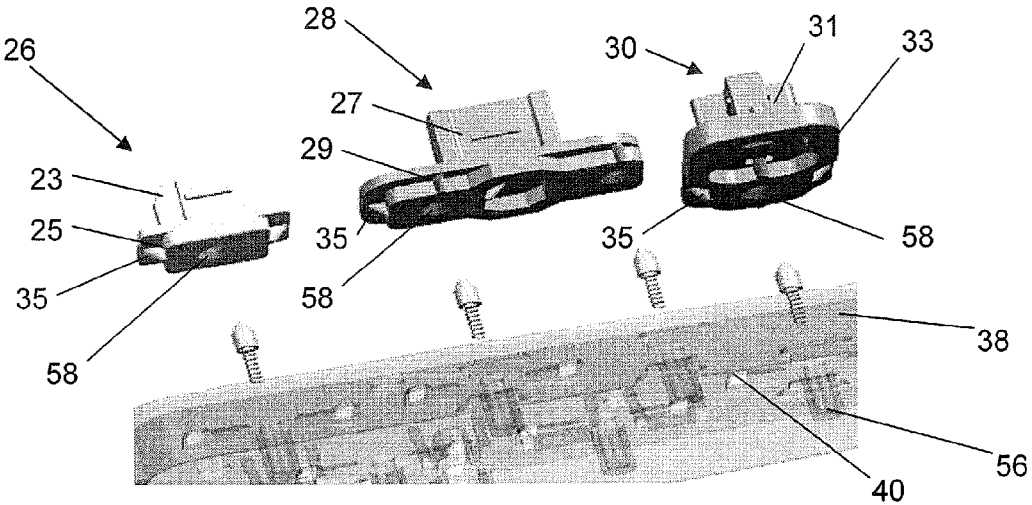
FIG. 6 is an exploded version of the perspective view of FIG. 5.

The e-pad 46 and its domes 48 preload the actuators 42, 44 to reduce rattling of the components. The interaction of the e-pad 46, domes 48, actuators 42, 44, actuator plates 26, 28, 30, and the corresponding knobs 14, 16, 18, is shown in FIGS. 4 to 6. It can be seen in FIG. 4 that by moving a knob 14, 16, 18, an attached one of the actuator plates 26, 28, 30 slides correspondingly in a plane substantially parallel to the housing 12. As can be seen in FIG. 5, the underside of each actuator plate 26, 28, 30 comprises one or more ramps 35, which are aligned with protrusions 60 through the apertures 40 to translate movement of the actuator plates 26, 28, 30 in one plane to movement of the protrusions 60 and thus the actuators 42, 44 in another plane substantially perpendicular to the plane in which the actuator plates 26, 28, 30 move. For ease of explanation, hereinafter, the plane defining movement of the actuator plates 26, 28, 30 will be referred to as a horizontal plane for horizontal movement, and the plane perpendicular to this will be referred to as a vertical plane for vertical movement. Therefore, turning back to FIG. 4, it can be appreciated that in this example, horizontal movement of the knobs 14, 16, 18 cause corresponding horizontal movement of the attached actuator plates 26, 28, 30, and the ramps 35 translate this horizontal movement to vertical movement of the actuators 42, 44 by engaging the protrusions 60 as the ramps 35 slide thereover.

FIGS. 5 and 6 also illustrate the interaction between the plunger assemblies 32 and the actuator plates 26, 28, 30. It can also be seen that the actuator plates 26, 28, 30, each comprise a corresponding upstanding post 23, 27, 31 for engaging the corresponding knob 14, 16, 18, and each comprises a corresponding base 25, 29, 33, for sliding over the sliding surface of the support 38. As best shown in FIG. 6, each base 25, 29, 33 comprises a depression 58 for each plunger assembly 32. The springs 36 are contained within the posts 56 and the plunger elements 34 bear against the depressions 58 to provide a return force to the respective actuator plate 26, 28, 30. The depression 58 in this example is concave providing a conical or curved ramp, and the plunger element 34 comprises a convex tip to permit movement of the actuator plate 26, 28, 30 that is necessary to engage the ramps 35 with the corresponding protrusions 60.

Figure 7B:
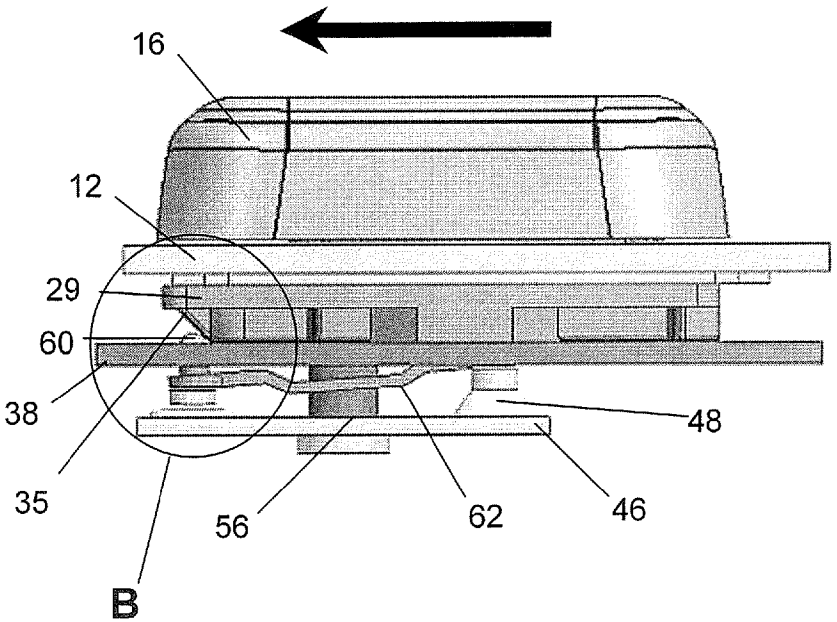
FIG. 7B is a layered elevation view of the sliding knob switch assembly of FIG. 7A in an actuation position.
Figure 7A:
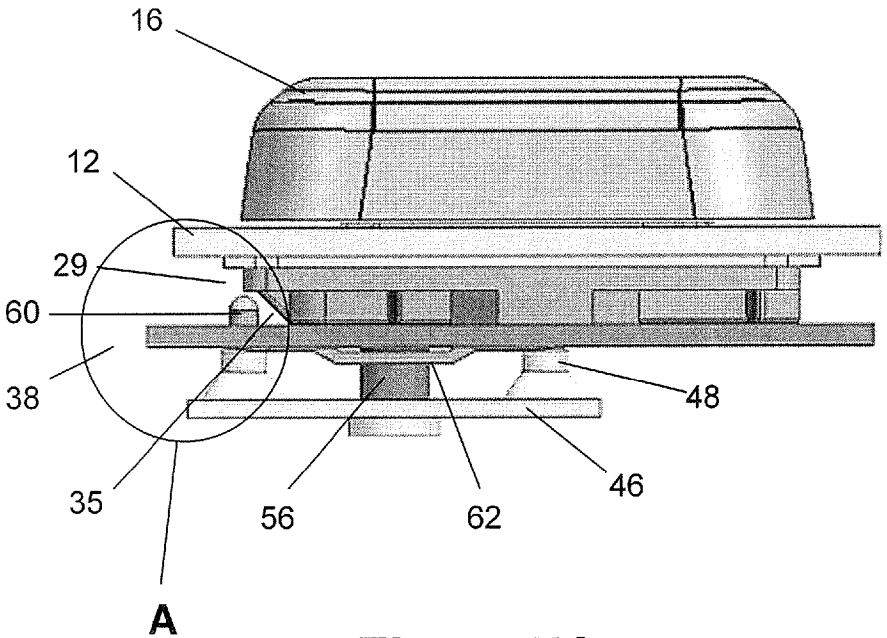
FIG. 7A is a layered elevation view of a sliding knob switch assembly in a rest position.

FIGS. 7A and 7B illustrate the seat function knob 16 in isolation to further illustrate the layering of the components of the switch assembly 10 for providing the seat angle, seat length and seat up/down functions. In the example shown in FIGS. 7A and 7B, the seat function knob 16 is at rest in FIG. 7A and the seat length function is being actuated in one direction (forward direction) in FIG. 7B. As can be seen in FIGS. 7A and 7B, the post 56 provides separation between the support 38 and the e-pad 46 and passes through central apertures 64 in the bridge actuator 42 (see also FIG. 10). Although the post 56 generally guides the actuator 42, it may be noted that the central aperture 64 is generally larger than the post 56 to permit tilting of the actuator 42 in a "teeter-totter" type fashion. As such, although the post 56 facilitates the assembly of the actuator 42 by generally aligning the actuator 42 with the apertures 40 in the support 38 and the underlying domes 48, once the switch assembly 10 is assembled (e.g. as shown in FIGS. 7A and 7B), the post 56 is not relied upon in operation of the actuator 42, such operation is instead guided by the apertures 40 and the domes 48.

Figure 8B:
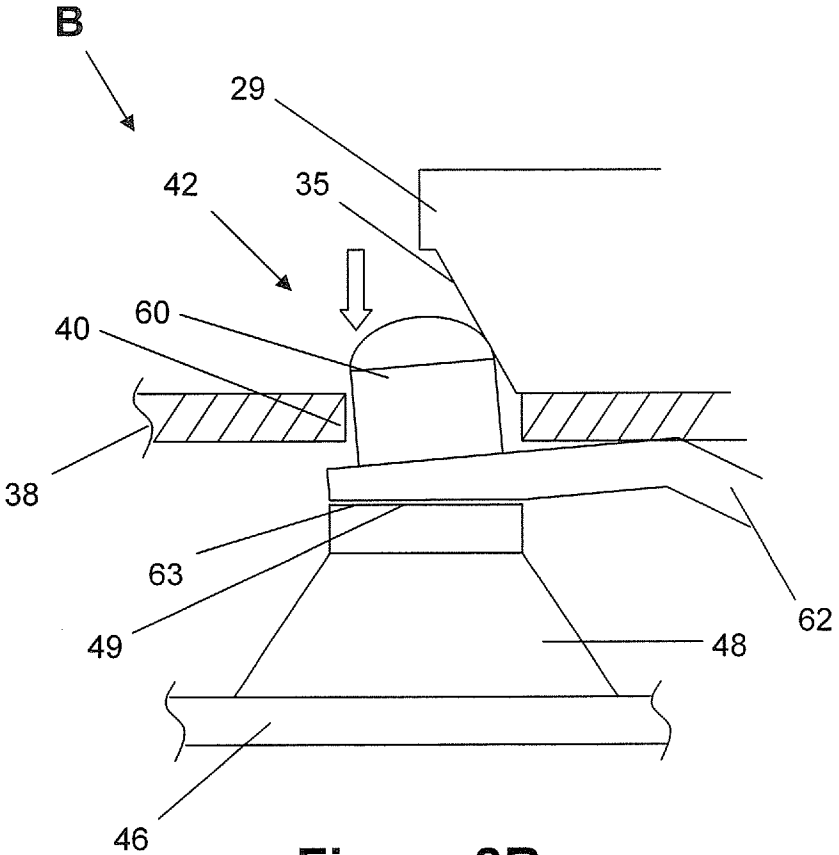
FIG. 8B is an enlarged sectional elevation view of portion B shown in FIG. 7B.
Figure 8A:
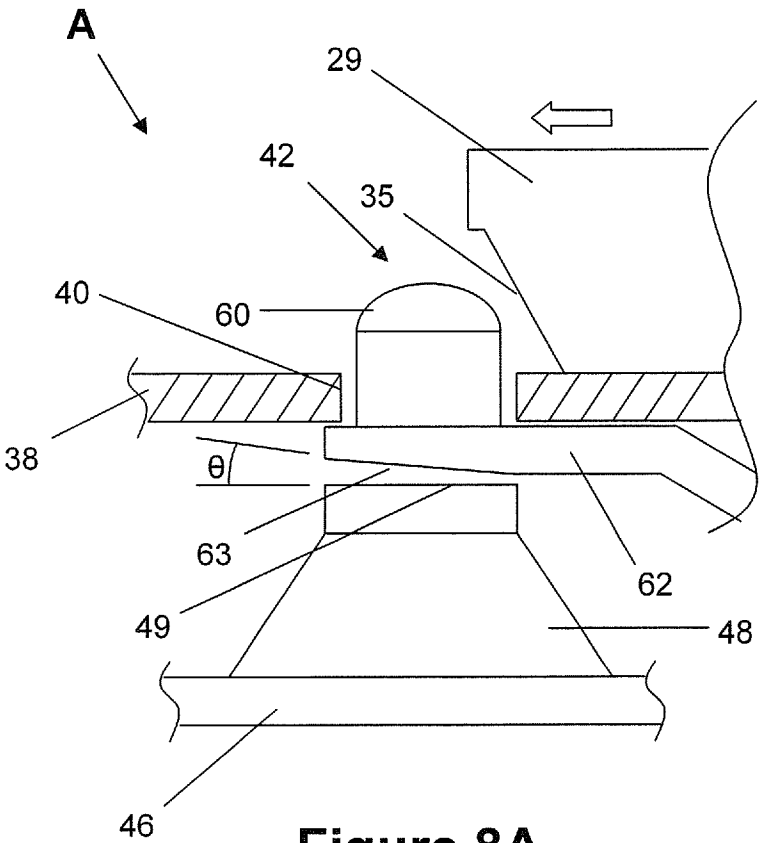
FIG. 8A is an enlarged sectional elevation view of portion A shown in FIG. 7A.

FIGS. 8A and 8B are enlarged versions of portions A and B shown in FIGS. 7A and 7B respectively. In FIG. 8A it can be appreciated that at rest, the actuator 42 is preloaded by the underlying domes 48 (one shown in FIG. 8A for simplicity) to thereby cause the protrusion 60 to extend through the aperture 40 and be exposed above the sliding surface provided by the support 38. The ramp 35 is located adjacent to, but at some distance from, the protrusion 60, which distance corresponds to the amount of travel desired in the seat function knob 16 in the corresponding direction. Also best seen in FIG. 8A is an angled surface 63 opposite the protrusion 60 for interacting with the top surface 49 of the underlying dome 48. In this example, the angle with respect to the top surface 49 of the dome 48 is denoted by θ. It can be appreciated that θ is chosen according to the angle through which the angled surface 63 rotates during movement of the actuator 42. As best seen in FIG. 8B, the angled surface 63 facilitates a generally parallel interaction between the angled surface 63 and the top surface 49 of the dome 48 at the point of contact to reduce the shear forces on the dome 48 thus prolonging the life of the dome 48. FIG. 8B also illustrates that movement of the base 29 along the upper surface of the support 38 engages the ramp 35 with the protrusion 60 thus forcing the actuator 42 to tilt towards the e-pad 46 in a way that the angled surface 63 engages the upper surface 49 when it is generally or at least more parallel to the upper surface 49 than it would be if the underside of the bridge 62 beneath the protrusion 60 were not angled. It can also be appreciated that as seen in FIG. 7B, since the actuator 42 is loosely fitted over the post 56 and the actuator 42 is supported between the domes 48 and the support 38, approximately one-half of the displacement of the actuator 42 at one end is required for the same horizontal displacement of the actuator knob 16 when compared to a fixed fulcrum. In other words, the "teeter-totter" configuration changes the fulcrum of the actuator 42 to ensure that only the dome 48 at the end corresponding to the direction of travel of the knob 16 is actuated without actuating the dome 48 at the other end. It has been found that a 2.5 mm travel of the knob 16 can translate to a 1.2 mm travel for the bridge actuator 42 and thus the dome 48 to close the contact. It can be appreciated that movement of the knob 16 in another direction will cause a different ramp 35 formed in the underside of the base 29 to engage a different protrusion 60 for a different actuator 42, 44.

FIG. 10 illustrates a primary actuator 42 and a secondary actuator 44 together in isolation to show how the relative profiles enable more than one actuator 42, 44 to be "stacked" over a particular post 56 by sliding the central apertures 64 over the post 56 during assembly. It can therefore be appreciated that the post 56 facilitates assembly of the actuators 42, 44 not only to align the protrusions 60 with corresponding apertures 40 but also to align a primary actuator 42 with respect to a secondary actuator 44. It can also be appreciated that by changing the relative profiles of the bridges 62, more than two actuators 42, 44 can be stacked. The loose fitting of the actuators 42, 44 over the post 56 also enables different switch configurations to be provided without major modifications to the housing 12. For example, in one application, a knob that moves in four directions could use both a primary actuator 42 and a secondary actuator 44 whereas in another application, a knob that only requires two directions would simply use only a primary actuator 42. However, it can be appreciated that the only change that needs to be made is the omission or addition of a secondary actuator 44. This facilitates common design platforms for different models.

Figure 9:
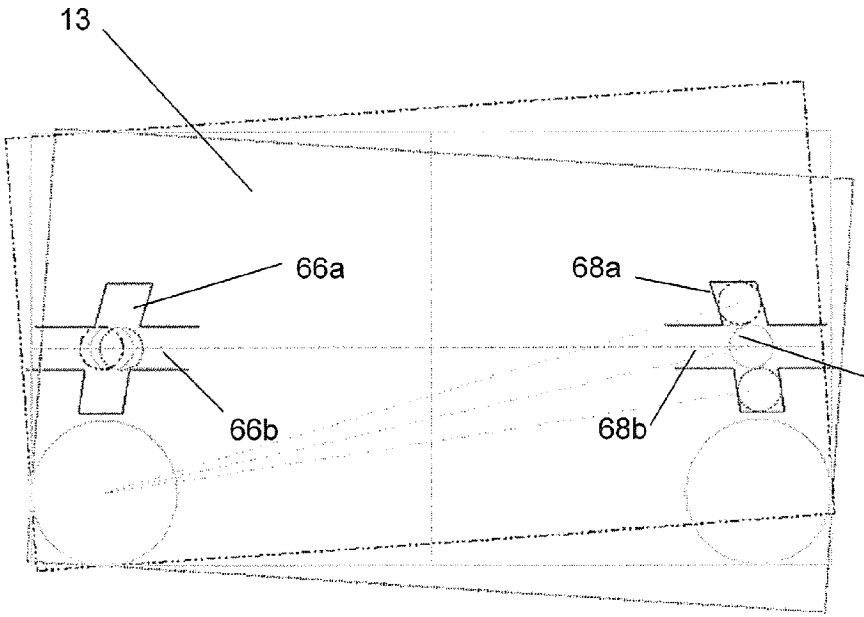
FIG. 9 is a schematic view of an intra-switch lock-out feature.

As noted above, the seat function knob 16 provides 3-functions comprising six (6) directions of movement. In order to inhibit the simultaneous activation of two functions at the same time, the base 29 of the actuator plate 26 can comprise a pair of extensions 102 that interact with corresponding t-shaped slots 66, 68 on the underside 13 of the housing 12, as shown in FIG. 9. It can be seen that at each end, the vertically oriented (with respect to the figure) slots 66*a*, 68*a* are angled with respect to the perpendicular such that both extensions 102 cannot move within the vertical slots 66*a*, 68*a* at the same time thus preventing simultaneous activation of the seat angle and seat up/down functions. The horizontal slots 66*b*, 68*b* also inhibit up or down, or tilt movements about each end, when seat length function is being used since the extensions 102 are constrained with the horizontal slots 66*b*, 68*b*. It can be appreciated that similar locking features can be provided to the other knobs 14 and 18 by including corresponding extensions and slots (not shown).

Figure 11:
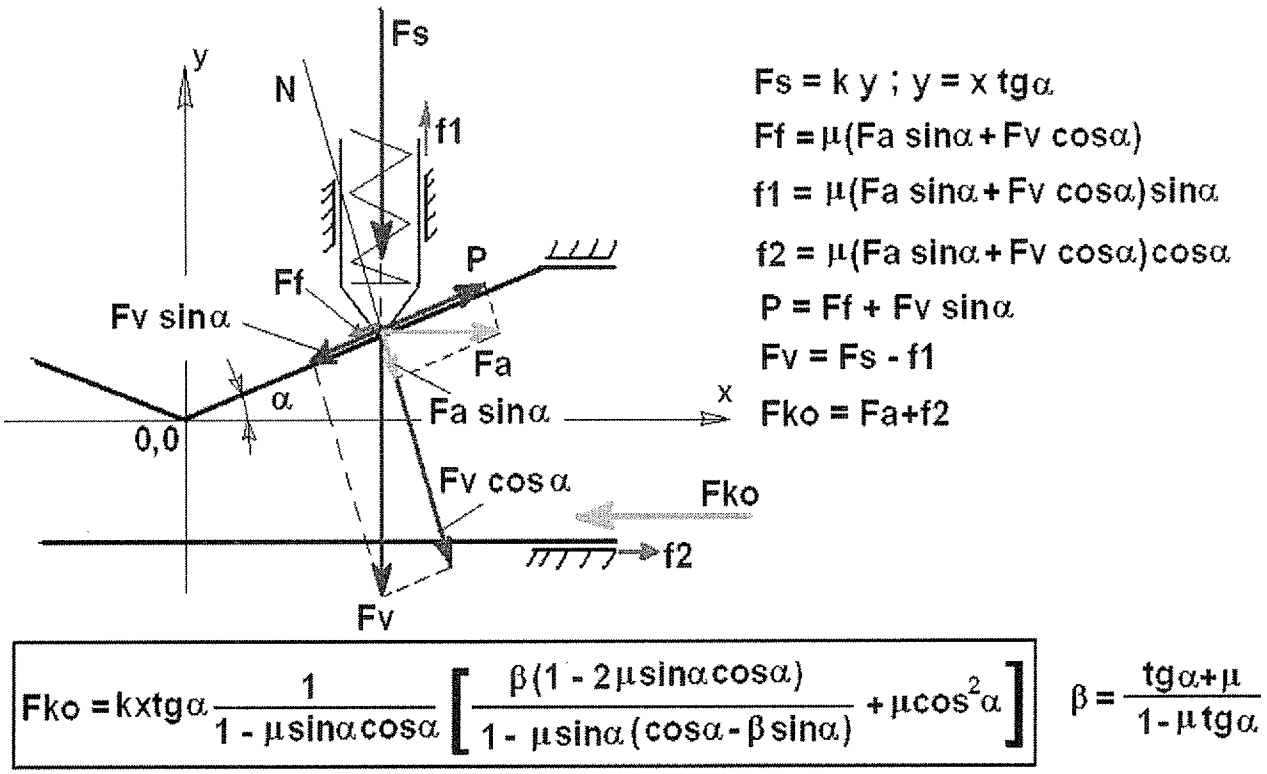
FIG. 11 is a diagram showing forces associated with use of the sliding knob switch assembly shown in FIGS. 7A and 7B.

FIG. 11 illustrates the forces involved in defining the tactile curve for the knob 16 due to the spring-loaded plunger elements 34. In FIG. 11, Fs is the spring force and P is the minimal force to move the plunger element 34 up on the inclined surface of the depression 58. As the plunger element 34 is guided vertically (i.e. constrained), an equivalent situation is considered by moving the depression 58 horizontally (i.e. via horizontal movement of the knob 16). Ff is the friction force between the tip of the plunger element 34 and the depression's surface, f1 is the friction force between the plunger element 34 and the interior wall of the post 56, and f2 is the friction force between the actuator plate base 29 and the underside surface 13 of the housing 12. Fko is the force applied to the knob 16 in order to start the plunger element's relative movement. The equations shown in FIG. 11 model these forces to determine the force Fko as shown.

The tactile curve is created by using the spring loaded plunger elements 34 on the depressions 58 with a variable slope angle. The spring coefficient K and angle α variations can be used to adjust the tactile curve according to the application.

A similar approach applies to calculating the reaction force created by the bridge actuators 42, 44 (which are preloaded by the domes 48) on the ramps 35 on the actuator plates 26, 28, 30. In this case, the spring force Fs is given by the elastomeric dome 48 pushing up on the bridge actuator 42, 44 and the tactile "ramp" is created by the angle of the ramp 35 on the plate 26, 28, 30.

Figure 12:
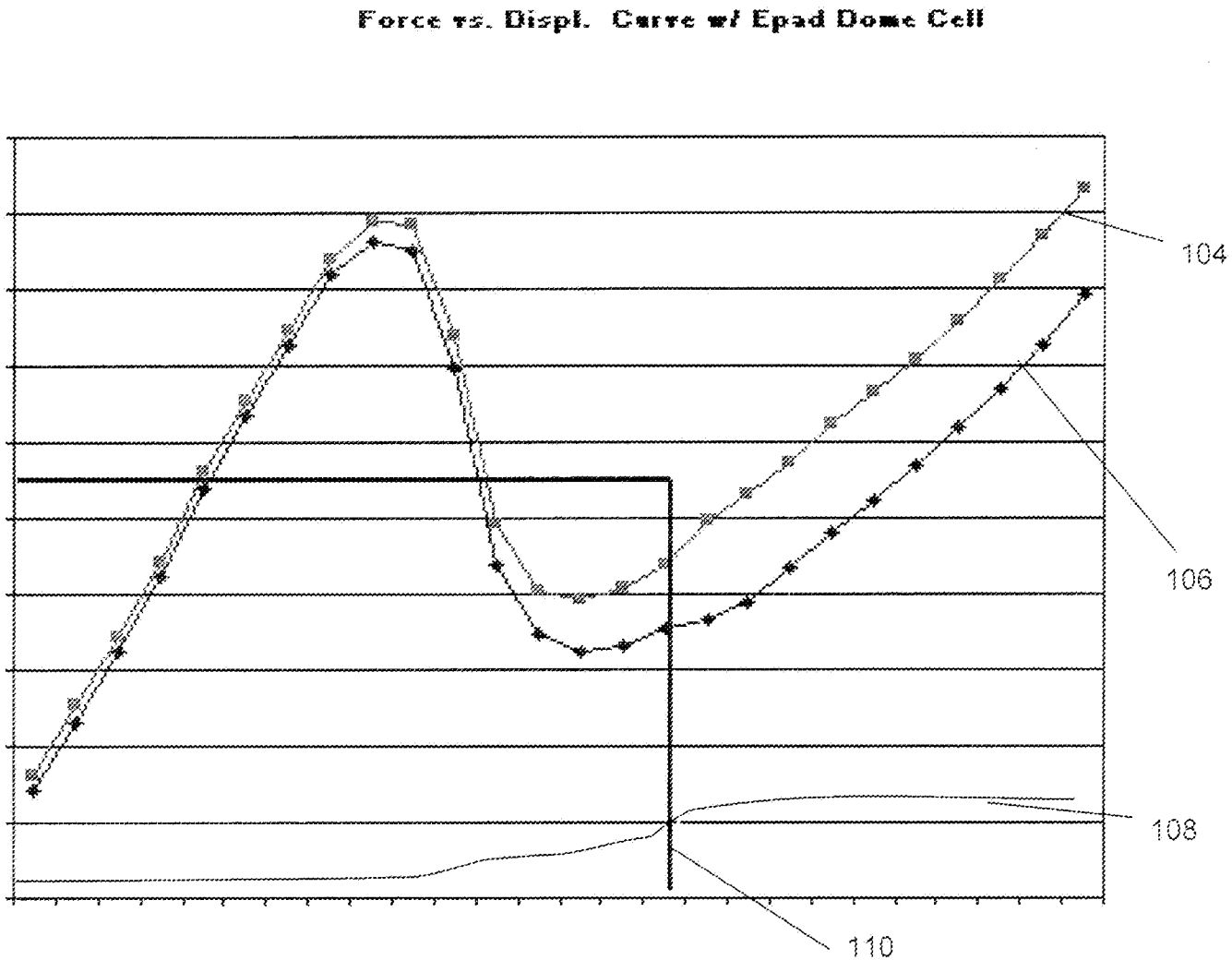
FIG. 12 is a force vs. displacement curve associated with use of the sliding know switch assembly shown in FIGS. 7A and 7B.

FIG. 12 illustrates a force versus displacement curve for operation of the knob 16. The uppermost curve 104 is a resulting force displacement curve representing the total tactile curve felt at the knob 16 (i.e. sum of the two forces represented by the curves 106 and 108. The middle curve 106 illustrates a calculated force versus displacement curve created by the interaction between the spring loaded plunger element 34 and the corresponding depression 58. The bottom curve 108 shows the force created by the interaction between the ramp 35 and the protrusion 60 according to the formula shown in FIG. 11, wherein the actuator 42, 44 is spring loaded by the e-pad contact domes 48 which, in this example, are low force/low stroke/no-snap. The marking 110 indicates the electrical contact point according to these curves 104, 106, and 108.

Figure 13:
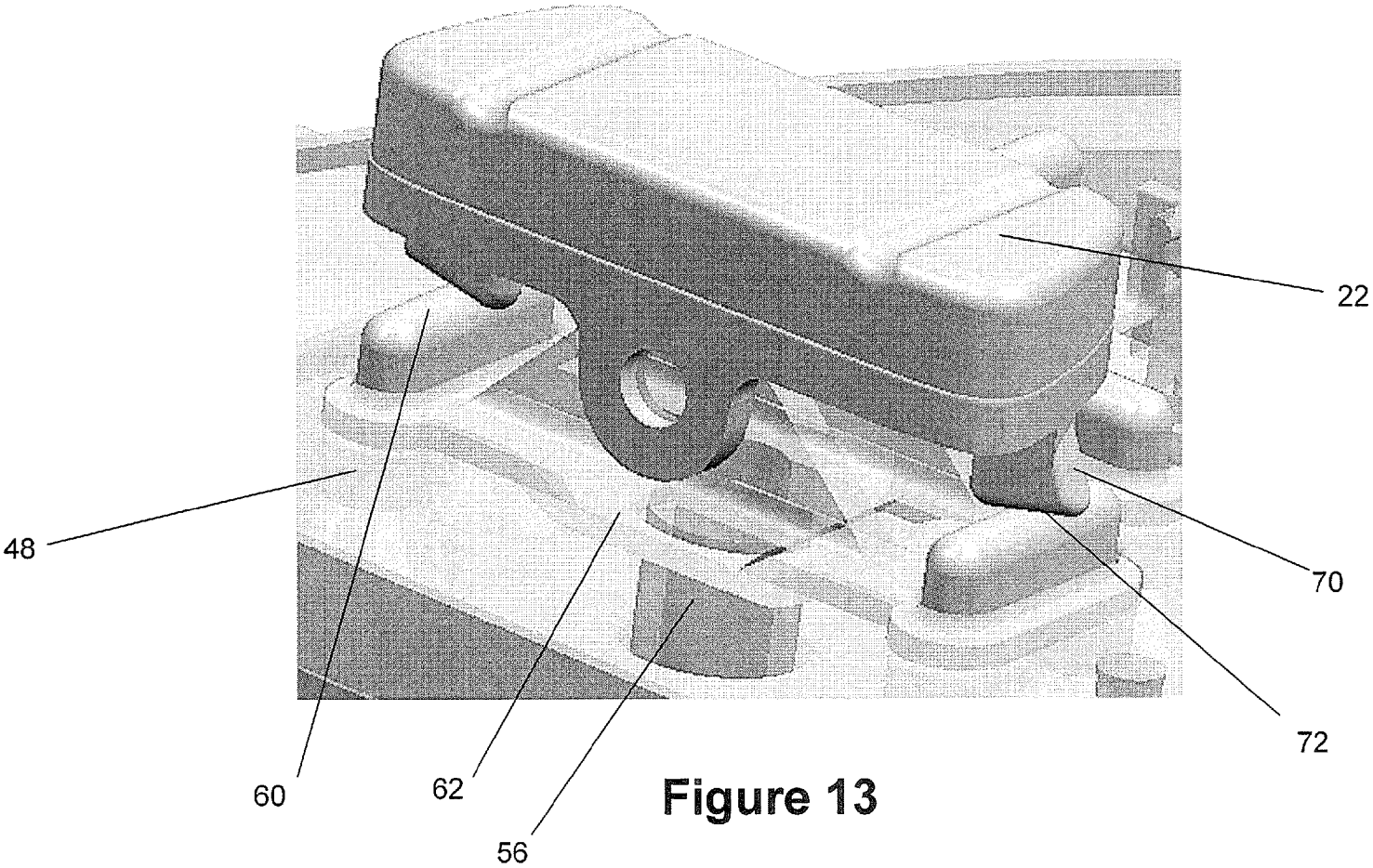
FIG. 13 is a perspective view showing use of a bridge actuator in a rocker-type switch assembly.

Turning now to FIG. 13, the backrest width knob 22 is shown to illustrate a further application of the bridge actuators 42. It can be seen that the same principles are used with the domes 48, post 56, and protrusions 60, however, as can be seen, a profiled protrusion 70 is provided on the underside of the knob 22 to operate on the protrusion 60 extending from the actuator 42. Accordingly, it can be appreciated that the bridge actuators 42 can be used in various applications and should not be limited to sliding knobs such as knobs 14, 16, and 18.

Figure 14:
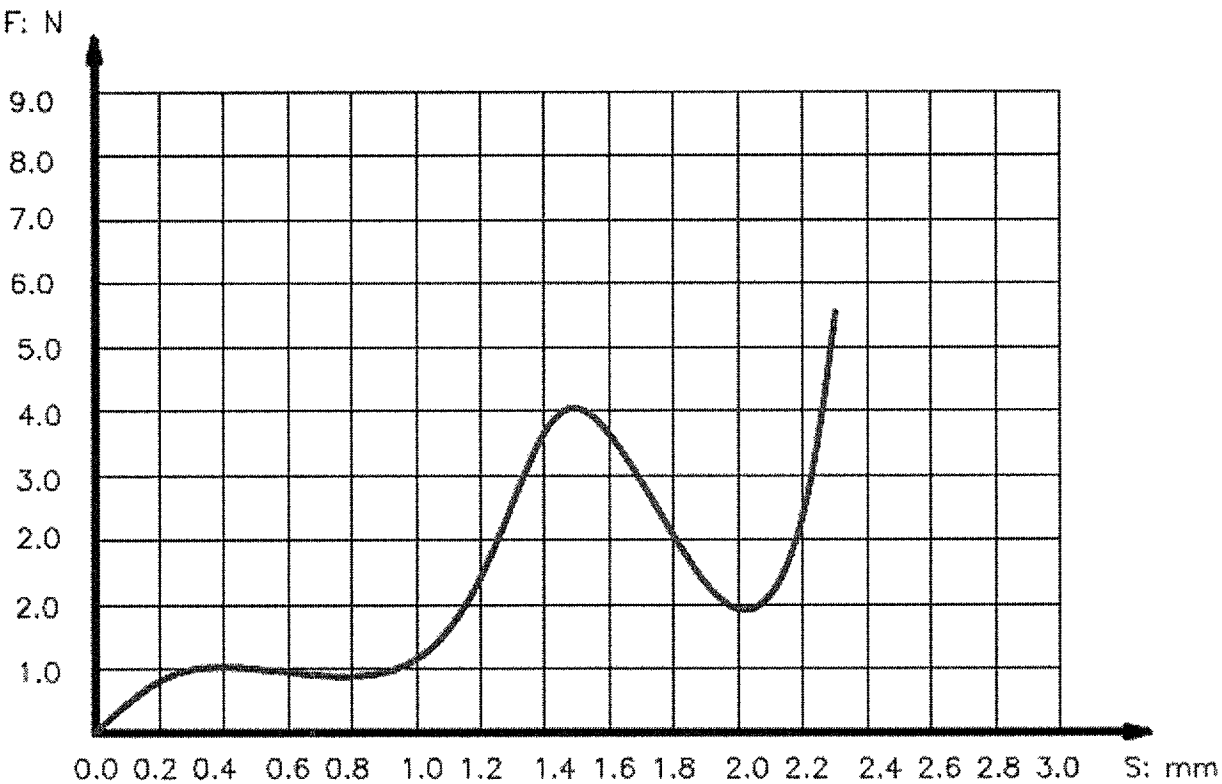
FIG. 14 is a force vs. displacement curve associated with pretension provided by the rocker-type switch assembly of FIG. 13.

FIG. 14 illustrates a force versus displacement curve that illustrates that activation of the memory and massage buttons 24, the 4-way lumbar knob 20, and the backrest width knob 22 imply a larger amount of pretension provided by the domes 48 to keep the knobs 24, 20, 22 and actuator bridges 42, 44 in the rest position. As such, keypads designed for long pre-stroke should be used for these functions. It may also be noted that the larger pre-stroke overcomes larger housing/actuator/knob tolerance stacking thus allowing for good tactile feel to be maintained.

Figure 15:
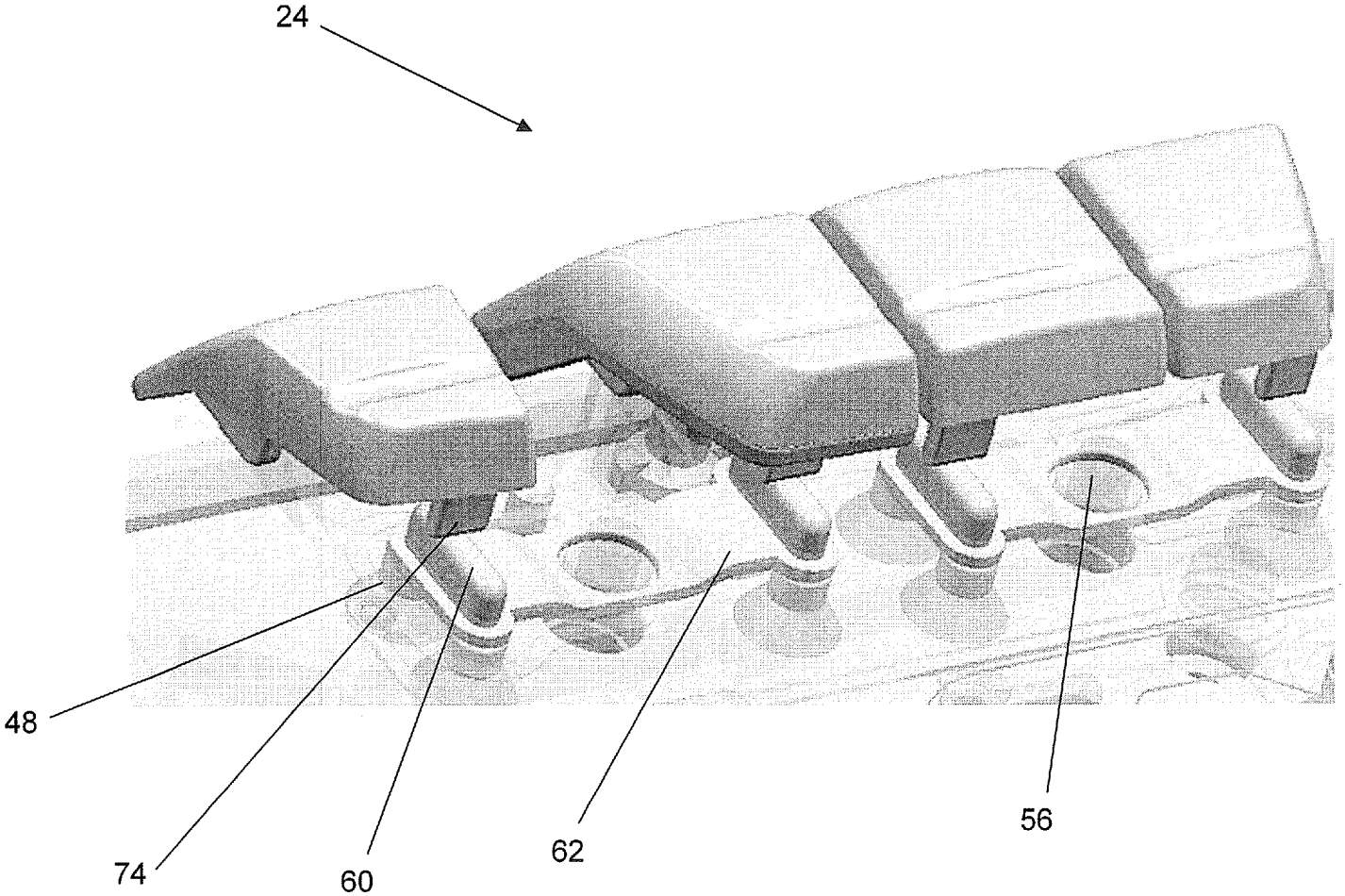
FIG. 15 is a perspective view showing further use of the bridge actuators in another rocker-type switch assembly.

FIG. 15 illustrates yet another example of application of the bridge actuators 42, 44 to different switch knobs and buttons, in this example showing the memory and massage buttons 24. Similar to what was shown in FIG. 13, a protrusion 74 on the underside of the buttons 24 enables activation of the button 24 to press the protrusion 60 on the bridge actuator 42, in a matter consistent with the operations shown in FIGS. 7A, 7B, 8A, and 8B for the seat function knob 16.

Figure 16A:
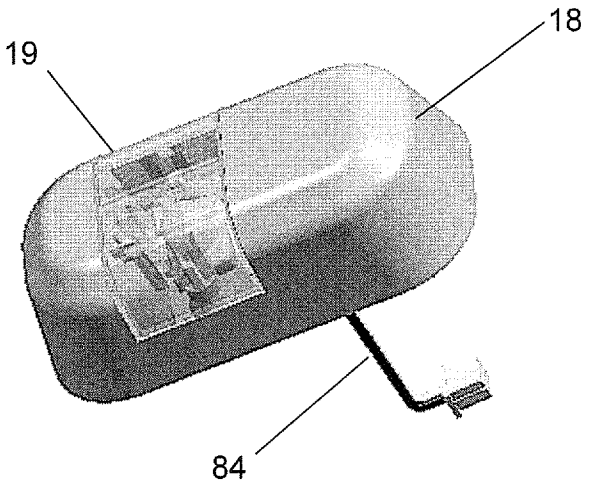
FIG. 16A is a perspective view of a recline knob assembly with an integrated backrest knob sub-assembly with the rocker knob removed.
Figure 16B:
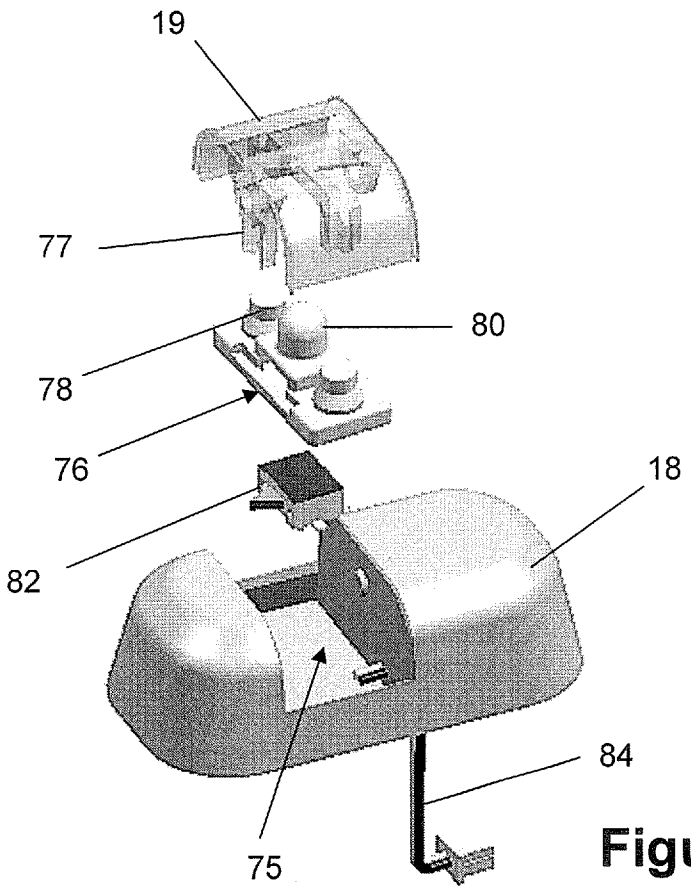
FIG. 16B is an exploded version of the perspective view of FIG. 16A including the rocker knob.

Further detail of the recline function knob 18 is shown in FIGS. 16A and 16B. As best seen in FIG. 16B, the recline function knob 18 rotatably supports the backrest button 19 within a cavity 75. The cavity 75 contains an elastomeric key pad 76 and a micro switch cell 82. The micro switch cell 82 interfaces with a connector harness 84 that connects it to the PCB 50. It can be appreciated that the use of a micro switch cell 82 instead of another PCB (not shown) utilizes fewer connections and eliminates the need for a second PCB. The keypad 76 is interposed between the switch cell 82 and the button 19 to preload the entire sub-assembly and thus prevent rattling while holding the switch cell 82 in place to oppose the force required to activate the switch cell 82. The keypad 76 comprises a central nub 80 that provides the preloading effect on the button 19 and oppositely placed inactive or "dummy" domes 78 to provide a tactile feel to the button 19. A downwardly extending key 77 interacts with the switch cell 82 to activate in two directions. It can be appreciated that by using a switch cell 82 instead of another PCB, more room can be created to accommodate the keypad 76 to thereby introduce the preloading and tactile feel to the sub-assembly to prevent rattling and improve the user experience. In addition to the tactile feel, the keypad 76 also creates environmental protection for the switch cell 82 to inhibit the effects of contaminates entering the sub-assembly.

Figure 17:
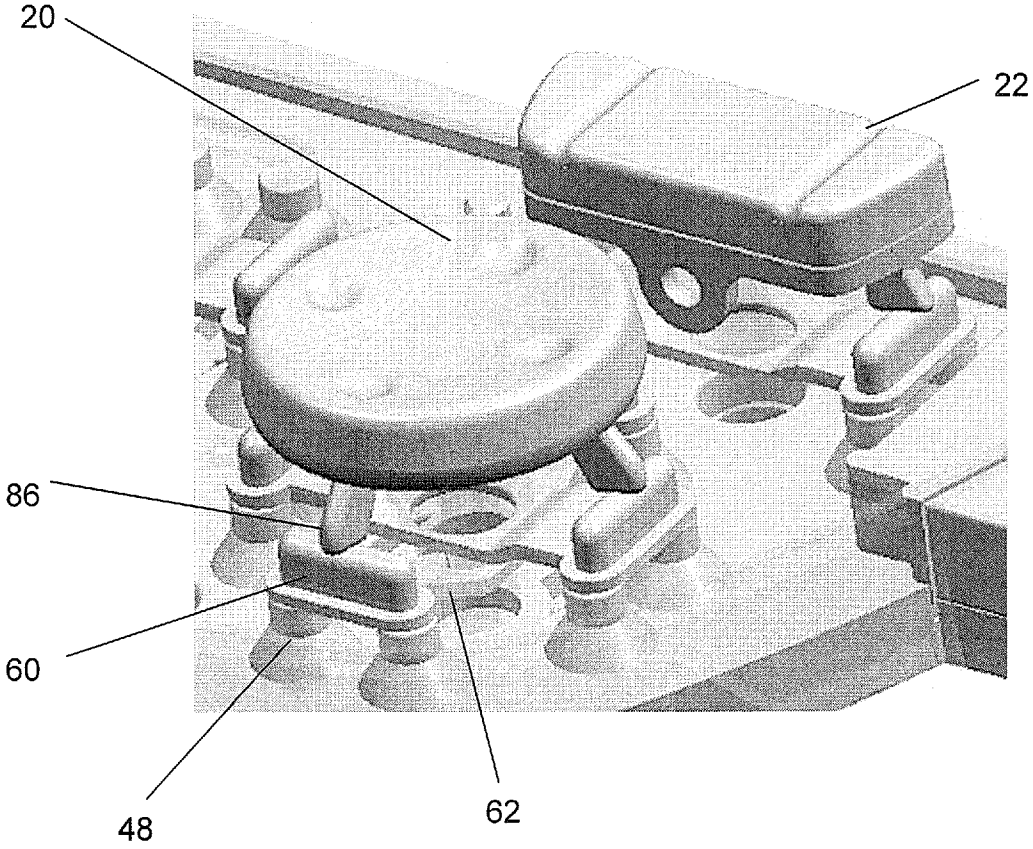
FIG. 17 is a perspective view of a 4-way lumbar knob assembly.
Figure 18B:
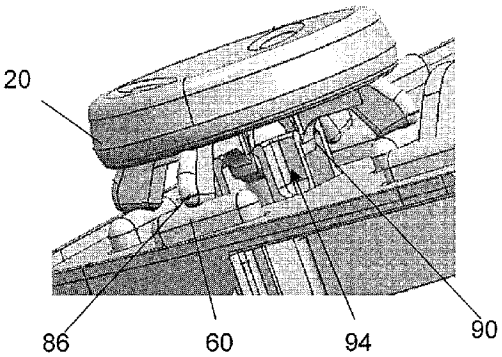
FIG. 18B is a perspective view showing further detail of the lumbar.
Figure 18C:
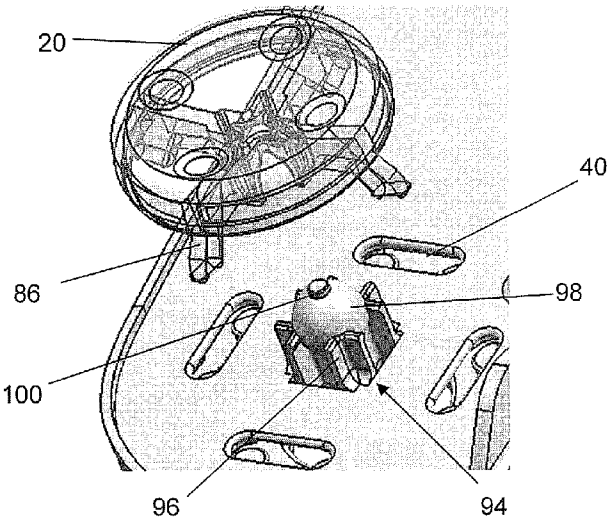
FIG. 18C is a perspective view showing a male connector for the lumbar knob.
Figure 18A:
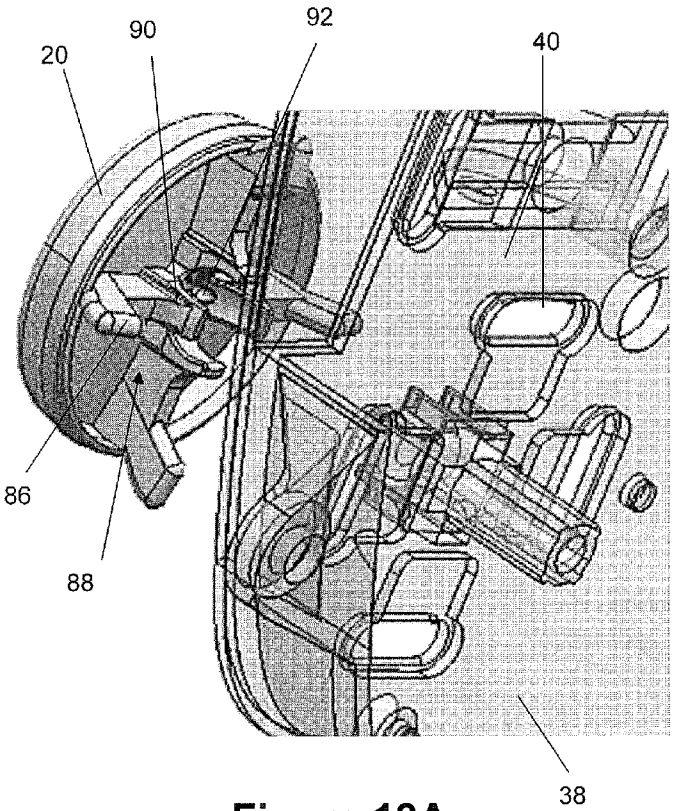
FIG. 18A is a perspective view of a lumbar knob in isolation showing a female connector for the lumbar knob.

Turning now to FIG. 17, further detail of the lumbar knob 20 is shown. It can be seen that the lumbar knob 20 can utilize a series of projections 86, i.e. one per direction of actuation, to operate on underlying protrusions 60 from corresponding bridge actuators 42, 44 and thus underlying domes 48 according to the principles discussed above. In order to provide more defined and controlled movements of the lumber knob 20 to better differentiate between the permitted actuation directions, FIGS. 18A, 18B, and 18C illustrate that the underside of the knob 20 can be contoured to provide a female, cup-shaped connection 88 that interacts with a spherical protrusion 98 at the distal end of a male connector 94. As best seen in FIG. 18A, the female connection 88 is contoured to include a series of tabs 90 that interact with corresponding slots 96 on the male connector 94 (see FIG. 18B). The tabs 90 and slots 96 guide movement of the lumbar knob 20 in four distinct directions and prevent rotation of the knob 20 about its axis. To further guide and restrict movement of the lumbar knob 20, the inside surface of the female connector 88 can be contoured to include a generally t-shaped depression 92 that interacts with a post 100 extending from the top of the spherical protrusion 98 of the male connector 94 as best seen in FIG. 18C. In this way, the post 100 further limits rotation of the knob 20 and further guides the knob 20 in the distinct directions of movement through by being inhibited by the contours defining the depression 92. Accordingly, the lumber knob 20 is provided with a better feel that more clearly distinguishes between the directions of movement.

Although the above has been described with reference to certain specific embodiments, various modifications thereof will be apparent to those skilled in the art as outlined in the claims appended hereto.

The invention claimed is:

1. A switch assembly comprising:

a housing;

an elastomeric pad supported by said housing to overlie a circuit board comprising a plurality of lower contacts, said elastomeric pad comprising a plurality of collapsible domes aligned with corresponding ones of said lower contacts, said domes each comprising an upper contact that engages a respective lower contact when collapsed;

one or more bridge actuators, each bridge actuator being supported by said housing between said elastomeric pad and a support surface, each actuator having a first end and a second end, each end being aligned with one of said plurality of domes and having an upwardly directed protrusion extending through a corresponding aperture in said support surface;

one or more actuator plates supported atop said support surface, each actuator plate having a ramp formed in its underside and aligned adjacent each upwardly directed protrusion such that a sliding movement of said actuator plate over said support surface engages said ramp with said protrusion to cause said protrusion to move in a downward direction towards a respective underlying dome to actuate a corresponding switch.

2. The switch assembly according to claim 1 wherein each end of said bridge actuator is inclined with respect to an upper surface provided by said domes such that downward movement of either end creates a substantially parallel engagement between the underside of each end and said upper surface.

3. The switch assembly according to claim 1 wherein said bridge actuator comprises a central aperture and is supported by said housing with a post extending through said aperture.

4. The switch assembly according to claim 1 further comprising one or more resilient plungers acting between said support surface and said actuator plate to maintain said actuator plate in a rest position.

5. The switch assembly according to claim 4 wherein said actuator plate comprises a depression on its underside which is aligned with a respective resilient plunger to guide said actuator plate back to said rest position.

6. The switch assembly according to claim 4 wherein said domes are low force domes.

7. The switch assembly according to claim 1 wherein said actuator plate comprises an upwardly extending post that extends through an upper aperture in said housing, and said assembly further comprises an actuator knob for controlling movement of said actuator plate.

8. The switch assembly according to claim 1 wherein said actuator plate comprises three pairs of ramps and said switch assembly comprises three corresponding bridge actuators, one of said pairs being aligned at first and second ends for actuating a pair of switches in a first direction along an axis connecting said first and second ends, a second of said pairs being aligned perpendicular to said first pair and positioned at said first end for actuating switches in a second direction caused by pivoting said actuator plate about said second end, and a third of said pairs being aligned perpendicular to said first pair and positioned at said second end for actuating switches in a third direction caused by pivoting said actuator plate about said first end.

9. A bridge actuator for actuating a pair of underlying elastomeric domes, said bridge actuator configured to be rotatably supported between said elastomeric domes and a support surface by a housing, said bridge actuator comprising:

a unitary member sized to extend between said pair of elastomeric domes, said unitary member comprising a first end and a second end, each end being aligned with a respective one of said pair of underlying elastomeric domes and having an upwardly directed protrusion sized to extend through a corresponding aperture in said support surface to enable a sliding movement of an actuator plate over said support surface engages a portion of said actuator plate with said protrusion to cause said protrusion to move in a downward direction towards a respective underlying dome to actuate a corresponding switch by said bridge actuator rotating relative to said housing.

10. The bridge actuator according to claim 9, further comprising an aperture between said first and second ends, said aperture for receiving a post extending from said housing or said support surface to guide said bridge actuator.

11. The bridge actuator according to claim 9, wherein at least one of said first and second ends comprises an angled surface opposite its corresponding protrusion.

12. The bridge actuator according to claim 9, wherein a portion thereof extending between said first and second ends is offset from said first and second ends.

* * * * *